United States Patent [19]

Sundkvist et al.

[11] 4,324,249

[45] Apr. 13, 1982

[54] DEVICE FOR SECURING A TEAT TO A PACIFIER

[76] Inventors: Per H. Sundkvist, 60 Lövängsvägen, S-183 30 Täby; Lars Oborg, 35 Bodalsvägen, S-181 36 Lidingö, both of Sweden

[21] Appl. No.: 151,438

[22] Filed: May 19, 1980

[51] Int. Cl.[3] ..... A61J 17/00; A61J 11/00

[52] U.S. Cl. ..... 128/360; 128/252

[58] Field of Search ..... 128/360, 252, 359

[56] References Cited

U.S. PATENT DOCUMENTS

| | | | |
|---|---|---|---|
| 2,889,829 | 6/1959 | Tannenbaum et al. | 128/252 |
| 3,886,949 | 6/1975 | Hurst et al. | 128/360 |
| 4,193,407 | 3/1980 | Edmark | 128/360 |

*Primary Examiner*—Robert W. Michell
*Assistant Examiner*—C. W. Shedd
*Attorney, Agent, or Firm*—Cushman, Darby & Cushman

[57] ABSTRACT

The present invention concerns an improved device for securing a teat (5), provided with a bead (6), to a pacifier, the device comprising a tapered part (1) formed with a flange (2), which part optionally has a bore (9) and has a snap action with an undercut cavity (8), the latter being defined by a protecting disc (4) and an annular flange (3) being either integral with or adapted to the disc, the flange exhibiting an inwardly directed shoulder (7); the tapered part (1) being moveable in the undercut cavity (8); and the teat (5) being secured between the tapered part (1) and the protecting disc (4).

3 Claims, 3 Drawing Figures

DEVICE FOR SECURING A TEAT TO A PACIFIER

The present invention concerns a device for attaching a teat to a pacifier, in which device the teat is secured by the aid of a flared, tapered part, which part is movable in an undercut cavity in the device. This is advantageous inasmuch as the teat, made of rubber, not constantly will be clamped against the protecting disc of the pacifier, and there will not be a constant abrasion of the rubber against the protecting disc, thus achieving the object to safer pacifiers.

A pacifier consists of a teat of rubber having a bead, which teat extends through an opening in a protecting disc, to which disc the teat is secured with some kind of securing device, and a grip portion. The protecting disc is a part of the attaching device.

The problem of a safe securing of the teat has been solved in different ways. In one solution the teat is clamped against the opening in the protecting plate with a plug, the latter being secured in such a way that the grip ring is attached to the pacifier in such a manner that it is in contact with the upper part of the plug, which thus is kept in position. In another solution the teat is forced over a V-shaped member having annular bead segments, on which member one of the shanks is provided with a resilient wedging member, against the action of which the shanks can be brought together. The V-shaped member press the teat against the opening edge of the protecting disc, and the member is attached to a grip ring.

Another solution of this problem is described in the Swedish Pat. No. 7316450-1. According to this the teat is secured with a double headed plug, the lower head of which is in snap action with a shoulder in the protecting disc to secure the plug and teat.

All prior art devices for securing a test to a pacifier exhibit the test clamped against the edge of the opening in the protecting disc, resulting in a constant abrasion of the rubber teat, meaning a continuous abrasive thinning and maybe finally a breaking. This is of obvious danger for a user.

This disadvantage is overcome by the present invention, which concerns a device for securing a teat, having a bead, to a pacifier, which device comprises a flared, tapered part, optionally having a bore, which part is in snap action with an undercut cavity defined by a protecting disc and an annular flange being either integral with or adapted to the disc, the flange exhibiting an inwardly directed shoulder; the tapered part being moveable in the undercut cavity; and the teat being secured between the tapered part and the protecting disc.

Figure 1:
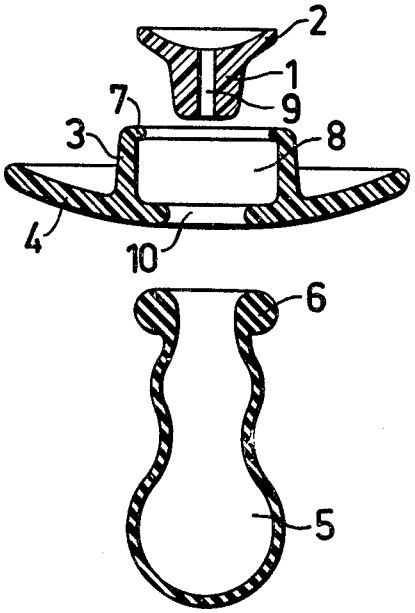
Figure 2:
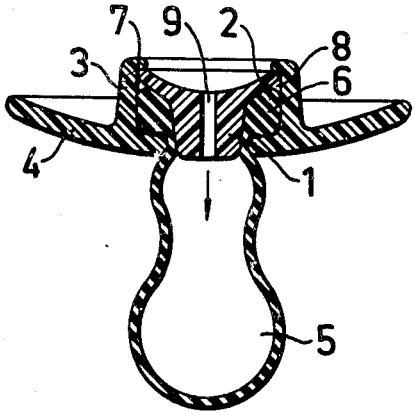
Figure 3:
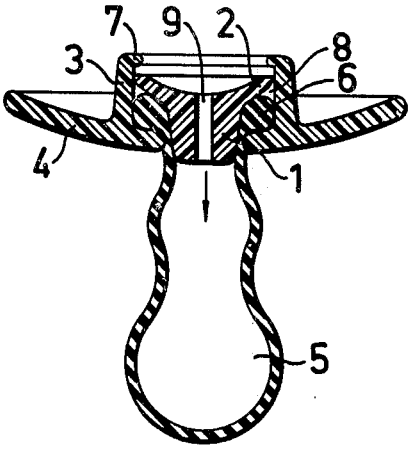

One embodiment of the invention is described with reference to the accompanying drawing, upon which FIG. 1 shows an exploded view of the device according to the invention, FIG. 2 shows a view of the device with an unstressed teat and FIG. 3 shows the same view, but with a stressed teat.

In FIG. 1 is shown a teat 5 having a bead 6, a protecting disc 5 having an integral annular flange 3, the latter exhibiting an inwardly directed shoulder 7; the disc 4, the flange 3 with the shoulder 7 defining an undercut cavity 8. The protecting disc 4 has an opening 10. A tapered part 1 formed with a flange 2 is in snap action with the cavity 8 and has a bore 9 for aeration of the teat 5.

In FIG. 2 is shown a teat 5 having a bead 6, the teat 5 being partly inserted in the undercut cavity 8 through the opening 12 of the protecting disc 4, and that in such a way that the bead 6 is within the cavity 8. The teat 5 is secured by a tapered part 1 having a flange 8, the tapered part being snapped into the undercut cavity 8. The tapered part 1 is moveable within the cavity 8 in the direction shown by the arrow. The tapered part has a bore 9.

In FIG. 3 is shown the device of FIG. 2, but with stress on the teat. When the teat is stressed the tapered part 1 is moved in the direction of the arrow pressing the teat 5 against the edge of the opening 10. When the stress ceases the teat and the tapered part return to resting position (FIG. 2).

In another embodiment of the invention the tapered part 1 has no bore; the annular flange 3 with an inwardly directed shoulder 7 can be integral with the protecting disc 4, or be a separate part attached to the protecting disc 4, e.g. by welding or adhesing.

The advantage with the present invention is i.a. that the more stress on the teat the better securing of the teat in the pacifier as the tapered part follows the movements of the teat and thus presses the teat harder against the edge of the opening in the protecting disc. The teat is further not constantly clamped against the edge of the opening in the protecting disc thus reducing the abrasion of the rubber teat, and thus due to the fact that the securing of the tapered part is not in connection with the opening in the protecting disc, but at the upper end, at the inwardly directed shoulder on the annular flange.

We claim:

1. A pacifier comprising: a disc having a central hole therethrough; an annular flange on said disc, said flange being circumferentially spaced from and surrounding said hole, said flange at its outer end having an inwardly directed shoulder and forming with said disc an undercut cavity; a teat having an annular bead defining an open end of the teat, said teat being located in said hole, with said bead residing in said cavity; a generally conical part having a circumferential flange at its larger end, said part being located in said cavity with said circumferential flange having a snap action with said inwardly directed shoulder so that said part is retained in said cavity, said part being axially movable within said cavity while being retained therein by said shoulder, said bead on said teat lying between the edge of said opening and said generally conical part and being secured within said cavity by said generally conical part.

2. A pacifier as in claim 1 wherein said generally conical part has an axial bore.

3. A pacifier in claim 1 wherein said annular flange is integral with said disc.

* * * * *